US005692463A

United States Patent [19]

Liang et al.

[11] Patent Number: 5,692,463

[45] Date of Patent: Dec. 2, 1997

[54] ELECTROMECHANICALLY ACTUATED VALVE WITH MULTIPLE LIFTS

[75] Inventors: Feng Liang, Canton; Craig Hammann Stephan, Ann Arbor, both of Mich.

[73] Assignee: Ford Global Technologies, Inc., Dearborn, Mich.

[21] Appl. No.: 746,594

[22] Filed: Nov. 12, 1996

[51] Int. Cl.[6] ..... F01L 9/04

[52] U.S. Cl. ..... 123/90.11; 251/129.01; 251/129.16; 251/129.18

[58] Field of Search ..... 123/90.11, 90.15; 251/129.01, 129.05, 129.1, 129.15, 129.16, 129.18; 335/256, 258, 266, 268

[56] References Cited

U.S. PATENT DOCUMENTS

| | | | |
|---|---|---|---|
| 4,455,543 | 6/1984 | Pischinger et al. | 335/266 |
| 4,515,343 | 5/1985 | Pischinger et al. | 123/90.11 |
| 4,682,574 | 7/1987 | Kreuter | 123/90.11 |
| 4,715,330 | 12/1987 | Buchl | 123/90.11 |
| 4,715,332 | 12/1987 | Kreuter | 123/90.11 |
| 4,719,882 | 1/1988 | Kreuter | 123/90.11 |
| 4,777,915 | 10/1988 | Bonvallet | 123/90.11 |
| 4,831,973 | 5/1989 | Richeson, Jr. | 123/90.11 |
| 5,070,826 | 12/1991 | Kawamura | 123/90.11 |
| 5,074,259 | 12/1991 | Pusic | 123/90.11 |
| 5,095,856 | 3/1992 | Kawamura | 123/90.11 |
| 5,115,772 | 5/1992 | Kawamura | 123/90.11 |
| 5,131,624 | 7/1992 | Kreuter et al. | 251/129.18 |
| 5,222,714 | 6/1993 | Morinigo et al. | 251/129.16 |

FOREIGN PATENT DOCUMENTS 1121469 10/1984 U.S.S.R. .

*Primary Examiner*—Weilun Lo
*Attorney, Agent, or Firm*—Donald A. Wilkinson

[57] ABSTRACT

An electromechanically actuated valve (12) for use as an intake or exhaust valve in an internal combustion engine. The valve (12) is actuated by a electromechanical actuator assembly (18) which includes a first electromagnet (22), second electromagnet (30) and third electromagnet (32). A disk (38) is fixedly mounted to the valve (12) in a gap between the second and third electromagnets. The second electromagnet (30) is slidable between the first electromagnet (22) and a stop (42), allowing the gap between the second electromagnet (30) and the third electromagnet (32) to vary. This allows for multiple valve lifts. A second spring (50), mounted between the second electromagnet (30) and disk (38), and a third spring (32), mounted between the disk (44) and an actuator housing (20), create a balanced oscillatory system which drives most of the valve movement during engine operation, thus reducing power requirements to actuate the valves while increasing the responsiveness of the valves.

19 Claims, 3 Drawing Sheets

ELECTROMECHANICALLY ACTUATED VALVE WITH MULTIPLE LIFTS

FIELD OF THE INVENTION

The present invention relates to electromechanically actuated valves, and more particularly to intake and exhaust valves employed in an internal combustion engine.

BACKGROUND OF THE INVENTION

Conventional engine valves (intake or exhaust) used to control the flow into and out of the cylinders of internal combustion engines, are controlled by camshafts that fix the amount of lift as well as the opening and closing times of the valves relative to a crankshaft position. While this may be generally adequate, it is not optimal, since the ideal intake and exhaust valve timing and lift vary under varying operating conditions of the engine. Variable valve timing and lift can account for such conditions as throttling effect at idle, EGR overlap, etc., to substantially improve overall engine performance. Although some attempts have been made to allow for variable timing based upon adjustments in the camshaft rotation, this is still limited by the individual cam lobes themselves.

Consequently, some others have attempted to do away with camshafts altogether by individually actuating the engine valves by some type of electromechanical or electrohydraulic means. These systems have not generally proven successful, however, due to substantial costs, increased noise, reduced reliability, slow response time, or increased energy consumption of the systems themselves. Further, although some systems allow for extensive control of valve timing, they are limited as with the conventional camshaft systems to a single valve lift distance that does not fully take advantage of engine efficiencies that can be had, or variable lift is achieved with degradation in valve performance.

One type of electromechanical system attempted employs simple solenoid actuators. But these have proven inadequate because they do not create enough magnetic force for speed needed to operate the valves without an inordinate amount of energy input. This is particularly true in light of the fact that the force profile is not desirable. The magnetic force increases as an armature disk approaches the electromagnet, causing a slap at end of stroke, creating noise and wear concerns, but not much force is available for acceleration at the beginning of the stroke, creating slow response time. Further, they are typically limited to a single amount of valve lift.

U.S. Pat. No. 5,222,714 attempts to overcome some of the deficiencies of an electromagnetic system by providing a spring to create an oscillating system about a neutral point wherein the spring is the main driving force during operation, and electromagnets provide holding forces in the opened and closed position, while also making up for frictional losses of the system. However, this system is still not able to fully utilize the possible efficiencies of the engine. A major drawback is that although this system allows for extensive control of valve timing, it is limited as with the conventional camshaft systems to a single valve lift distance, thus not fully taking advantage of engine efficiencies that can be had.

Hence, a simple, reliable, fast yet energy efficient actuator for engine valves is desired, with the flexibility to vary both valve timing and lift to substantially improve engine performance, without degrading valve performance with varying lift.

SUMMARY OF THE INVENTION

In its embodiments, the present invention contemplates an engine valve assembly for an internal combustion engine having a cylinder head. The engine valve assembly includes an engine valve having a head portion and a stem portion, adapted to be slidably mounted within the cylinder head, and an actuator housing adapted to be mounted to the engine and surrounding a portion of the valve stem. A first electromagnet is fixedly mounted relative to the actuator housing, encircling a portion of the valve stem, a second electromagnet is slidably mounted relative to the actuator housing, encircling a portion of the valve stem farther from the head of the engine valve than the first electromagnet, and a third electromagnet is fixedly mounted relative to the actuator housing, encircling a portion of the valve stem farther from the head of the engine valve than the second electromagnet and spaced from the second electromagnet to form a gap. A disk is fixedly mounted to the engine valve stem and located between the second and third electromagnet. The engine valve assembly also includes first biasing means for biasing a portion of the second electromagnet away from the first electromagnet, second biasing means for biasing the disk away from the second electromagnet, and third biasing means for biasing the disk toward the second electromagnet. Stop means limit the sliding of the portion of the second electromagnet away from the first electromagnet, allowing for a variable gap between the second electromagnet and third electromagnet, whereby variable engine valve lift may be achieved.

Accordingly, an object of the present invention is to provide an electromechanically actuated engine valve having variable timing and lift which is capable of operating at speeds required by internal combustion engine operation, with minimal energy consumption.

An advantage of the present invention is the ability to provide dual valve lifts through electromagnetic actuation, while minimizing the energy needed by using resonant mode behavior of a spring system, i.e., acceleration of the valve from rest and then deceleration to a low velocity, thus avoiding impacts among components, to reduce potential noise and wear concerns.

An additional advantage of the present invention is that it has a movable electromagnet which automatically adjusts the equilibrium point of the oscillating spring system in the valve actuator to the middle of either a mid-open or a full open position; thus allowing for a two open position operation, but without sacrificing the resonant mode operation that will cause the valve to seat softly against the valve seat with minimal energy dissipation.

DETAILED DESCRIPTION OF THE PREFERRED EMBODIMENTS

Figure 1:
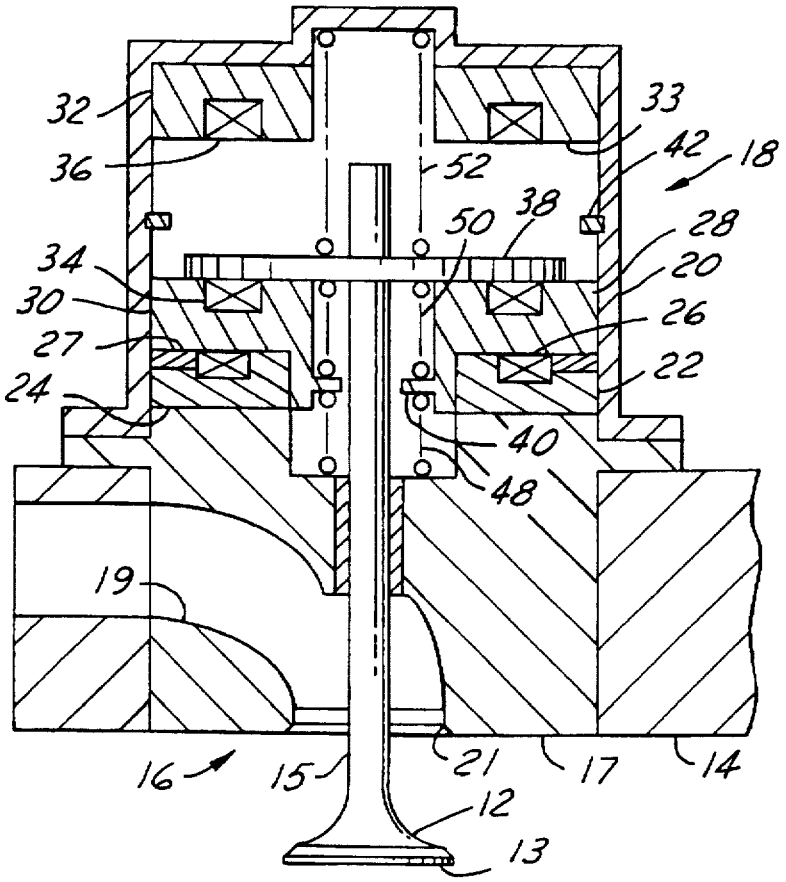
FIG. 1 is a Schematic view of an engine valve assembly, with the valve shown in a fully open position, in accordance with the present invention.
Figure 2:
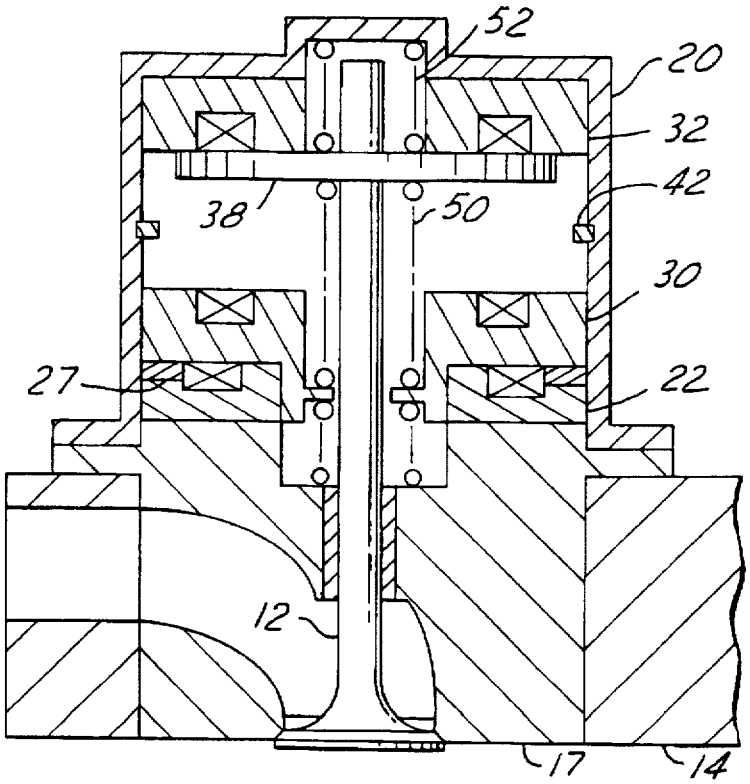
FIG. 2 is a schematic view similar to FIG. 1, but with the valve shown in its closed position.
Figure 3:
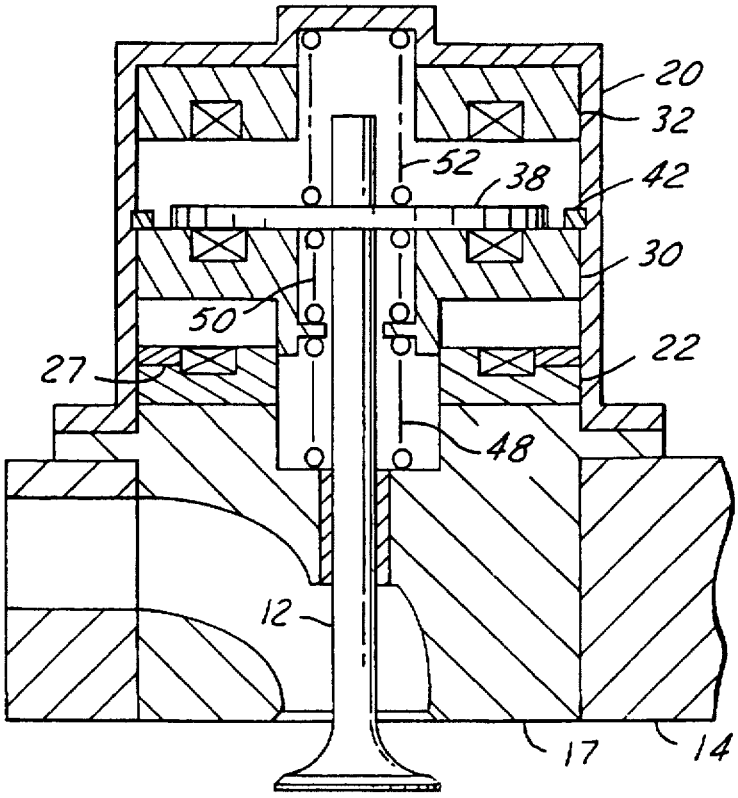
FIG. 3 is a schematic view similar to FIG. 1, but with the valve shown in its mid-open position.

FIGS. 1–3 illustrate a first embodiment of the present invention. An engine valve 12, intake or exhaust as the case may be, is slidably mounted within an insert 17, secured in a cylinder head 14 of an internal combustion engine 16. The insert 17 and cylinder head 14 define a port 19, again either intake or exhaust, and a valve seat 21. The insert 17 allows for easier assembly of components into the cylinder head 14, and later servicing, as a module, but if preferred, the insert portion can be integral with the cylinder head 14.

The engine valve 12 includes a head portion 13, which seats against the valve seat 21 in its closed position, and a stem portion 15. This engine valve 12 controls the fluid flow into or out of a cylinder (not shown) within the engine 16.

An electromechanical actuator assembly 18 engages the valve stem portion 15 and drives the engine valve 12. The actuator assembly 18 includes a housing 20 mounted to the cylinder head insert 17, or cylinder head 14, if so desired. Within the housing 20 is mounted a first electromagnet 22, which is fixed relative to the housing 20. The first electromagnet 22 includes an annulus shaped first core member 24, made of a magnetically conductive material, encircling a portion of the valve stem 15. The first electromagnet 22 also includes a first coil 26, extending circumferentially through the core member 24 forming an annulus shape near the upper surface of the core member 24, and an annulus shaped permanent magnet 27 located radially outward from the coil 26. The permanent magnet 27 is embedded in the flux path of first electromagnet 22.

An annulus shaped, second core member 28, also made of a magnetically conductive material, is mounted in and can slide relative to the housing 20 and forms part of a second electromagnet 30. A second coil 34 extends circumferentially through the second core member 28 forming an annulus shape near the upper surface of the second core member 28. A third electromagnet 32 includes a third core member 33, which is fixed relative to the housing 20. A third coil 36 extends circumferentially through the third core member 33 forming an annulus shape near the lower surface of the third core member 33. The three coils are connected to a conventional source of electrical current (not shown), which can be selectively turned on and off to each one independently by a conventional type of controller, such as an engine computer (not shown).

Mounted to the valve stem 15 is a ferrous, annular disk 38, which is fixed relative to and moves with the stem 15. This disk 38 is located between the upper surface of the second electromagnet 30 and the lower surface of the third electromagnet 32. Also an annular protrusion 40 extends radially inward from the second core member 28. A stop ring 42 is mounted to and extends radially inward from the housing 20, and is located between the second electromagnet 30 and the third electromagnet 32. This stop ring limits the amount of travel of the second electromagnet 30 toward the third electromagnet 32.

A first spring 48 is mounted between the cylinder head insert 17 and the bottom surface of the annular protrusion 40, a second spring 50 is mounted between the top surface of the annular protrusion 40 and the disk 38, while a third spring 52 is mounted between the top surface of the disk 38 and the housing 20. The first spring 48 biases the second electromagnet 30 toward the stop ring 42, and only acts to shift the operating mode from full open to mid-open. The second and third springs 50, 52 are biased such that each counteracts the force of the other to cause the neutral or resting position of the engine valve 12 to be a partially opened position. These two spring 50, 52 have substantially identical spring constants and are positioned to hold the disk 38 half way between the second electromagnet 30 and the third electromagnet 32. This half-way position occurs, for instance, when the engine 16 is not operating, and thus, the electromagnets are not activated. By having this half-way position, an oscillating system can be created by the two springs during engine valve operation such that, when the disk 38 is released, by either electromagnet 30, 32, the force of the springs 50, 52 is such as to accelerate, then decelerate, the valve 12 so that, neglecting friction and length tolerances, the valve 12 comes to a stop at the other electromagnet 30, 32 without impact.

The operation of the electromechanical actuator 18 and resulting valve motion will now be described. When the engine is not in operation, the engine valve 12 rests in a neutral position, partially open, with the disk 38 half-way between the second and third electromagnets 30, 32. To initiate valve opening from the neutral position, the coil 34 in the second electromagnet 30 is energized, causing the disk 38 to be pulled downward towards it, compressing the second spring 50. Engine valve 12, as a result, is pulled to its open position, as is illustrated in FIG. 1. The second electromagnet 30 stays energized to hold this position against the bias of the second spring 50. The compressed spring 50 now stores potential energy for the oscillating system which will drive most of the engine valve movement during engine operation.

FIG. 1 shows a full open position for the engine valve 12, with the permanent magnet 27 holding the second electromagnet 30 against the bias of the first spring 48. With this approach, a pulse of current is applied to the first coil 20 in a direction such as to enhance the flux provided by the permanent magnet 27. The large magnetic field is enough to pull the second electromagnet 30 downward. Once the two electromagnets are in contact, the field from the permanent magnet 27 alone is sufficient to hold the second electromagnet 30 in place.

The first electromagnet 22 may also be energized to a low level if needed to assist the permanent magnet's holding power. This depends upon the size of the permanent magnet 27 and spring force of the first spring 48. Generally, though, it is preferred that the permanent magnet 27 is strong enough to hold the second electromagnet 30 in position even in the absence of flux provided by the first coil 26.

To begin to close the engine valve 12, the second electromagnet 30 is de-energized, allowing the second spring 50 to push the disk 38 upward. To finish closing the engine valve 12 and hold it there, the third coil 36 is energized, causing the disk 38 to be pulled upward towards it by magnetic force. As a result of this, the disk 38 compresses the third spring 52. The third electromagnet 32 stays energized to hold the engine valve 12 in the closed position against the bias of the third spring 52, as is illustrated in FIG. 2.

The oscillating type of system described herein creates a situation where the work done by the electromagnets is mostly used to hold the valve 12 in a particular position, while most of the work of moving the valve 12 is done by the springs. Only a small portion of the work of moving the valve 12 is done by the electromagnets, to make up for friction effects and other energy losses in the system. In this way, the energy needed to drive this electromagnetic actuator 18 is minimized.

In order to operate the engine valve 12 in its mid-open position mode, the second electromagnet 30 is released from the first electromagnet 22. To release the second electromagnet 30, a pulse of current is once again applied to the coil 26 of the first electromagnet 22, but this time in a direction such as to cancel the flux from the permanent magnet 27.

The second electromagnet 30 is now free to slide within the housing 20, and consequently, the first spring 48 pushes it upward to the stop ring 42, see FIG. 3. So, in essence, the second electromagnet 30 causes the second and third springs 50, 52 to be compressed by an equal amount. Thus, the equilibrium point of engine valve 12 is still in the center of the now narrower gap between these electromagnets. The second and third electromagnets 30, 32 operate the same as with the full open mode, but with the valve traveling through a shorter distance since the second electromagnet 30 is held against the stop ring 42 by the first spring 48.

In this way, the valve 12 still oscillates between the closed position and mid-open position, coming to a controlled stop at each end of its stroke. The mid-open position can be any fraction of the full open position depending upon the characteristics and operating conditions desired of the particular engine. Moreover, the second electromagnet 30 moves only once during each switch between full and mid-open operation, minimizing the significance of any noise or wear concerns resulting from impact of the second electromagnet 30 against the stop ring 42.

To begin to open the valve 12 from the closed position, the third coil 36 is de-energized, allowing the third spring 52 to push the engine valve 12 downward. The second electromagnet 30 is energized to pull the disk 38 downward and lock the valve 12 in its open position. This is the same procedure for both full and mid-open positions.

By utilizing the resonance of the two springs in the actuator 18 to accomplish much of the movement, the response time is improved over merely providing electromagnets, and with less power consumption. Further, the springs allow for a system with softer landings, for the closed and two open positions, than a pure electromagnet actuated system, thus reducing the noise that otherwise may be generated. The multiple valve lifts are also determined by simple on/off commands of the electromagnets rather than attempting to precisely adjust and control the electric current used to power the magnets or other complex means that may be used to create mid-opened positions.

Figure 4:
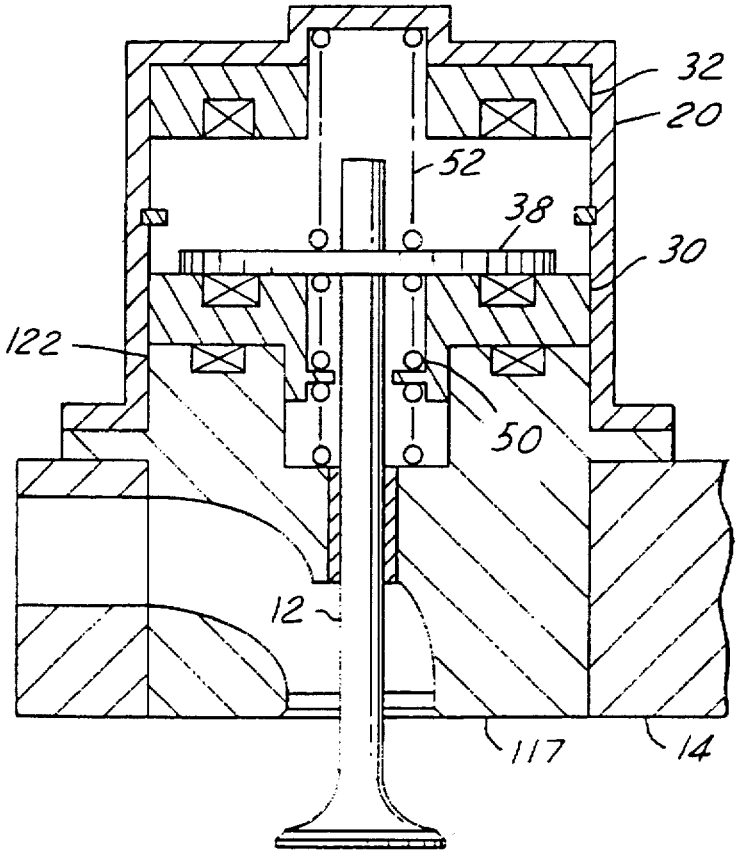
FIG. 4 is a schematic view similar to FIG. 1, but illustrating a second embodiment of the present invention.

A second embodiment of the present invention is illustrated in FIG. 4. In this embodiment, like elements with the first embodiment will be similarly designated, while changed elements will also be similarly designated but with 100-series designations. There is now no permanent magnet to hold the second electromagnet 30 against the first electromagnet 122. The first electromagnet 122 can now be integral with the insert 117 in order to ease assembly of components. The advantage of eliminating the permanent magnet is that generally, it has to be shielded from the high temperatures of the engine head by some means, such as a gasket, etc. Further, a disadvantage of employing a permanent magnet as in the first embodiment is that the permanent magnet appears like an air gap to the flux generated by the first coil 26. Thus, higher currents need to be used to generate the same magnetic field. However, for this embodiment, when the valve 12 is operating in the full open mode, the first electromagnet 122 must be energized at all times to hold the second electromagnet 30.

Figure 5:
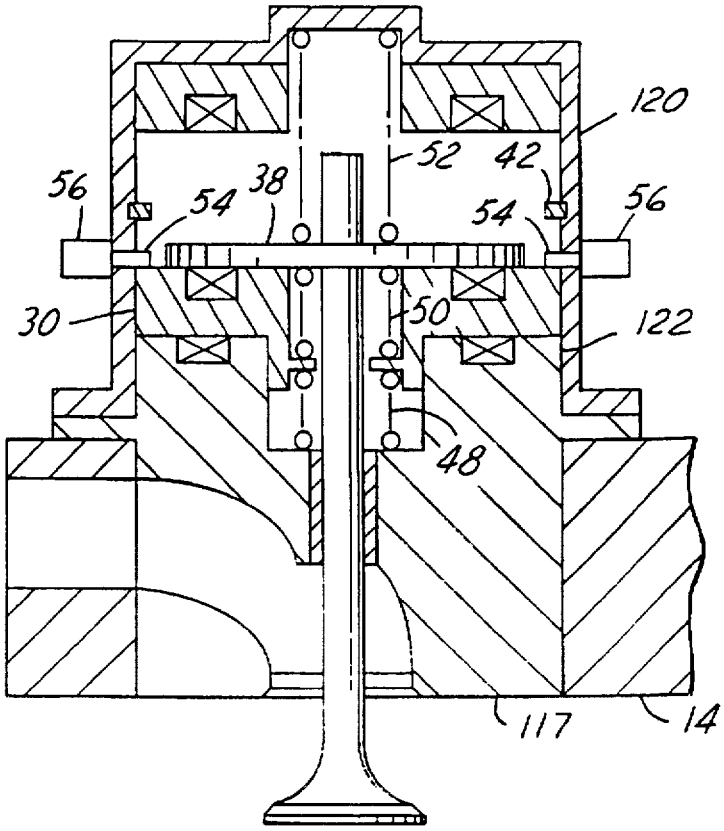
FIG. 5 is a Schematic view similar to FIG. 1, but illustrating a third embodiment of the present invention.

A third embodiment of the present invention is illustrated in FIG. 5. This is the same as the second embodiment, with the removal of a permanent magnet and integral first electromagnet 122 with the insert 117. In addition, spring loaded pins 54 and corresponding solenoid actuators 56 are mounted to the actuator housing 120. The solenoids 56 are electrically connected to a conventional source of electric current (not shown), which can be selectively turned on and off by a conventional controller, such as an engine computer (not shown). The pins 54 act just like the stop ring 42 to hold the second electromagnet 30 in position once the first electromagnet 122 has drawn the second electromagnet 30 down. Thus, the pins 54 take the place of the permanent magnet by holding the second electromagnet 30 against the bias of the first spring 48 without requiring the first electromagnet 122 to remain energized. To release the second electromagnet 30, the solenoids 56 are pulsed to briefly withdraw the pins 54, allowing the second electromagnet 30 to slide up to the stop ring 42 for mid-open valve operation.

Figure 6:
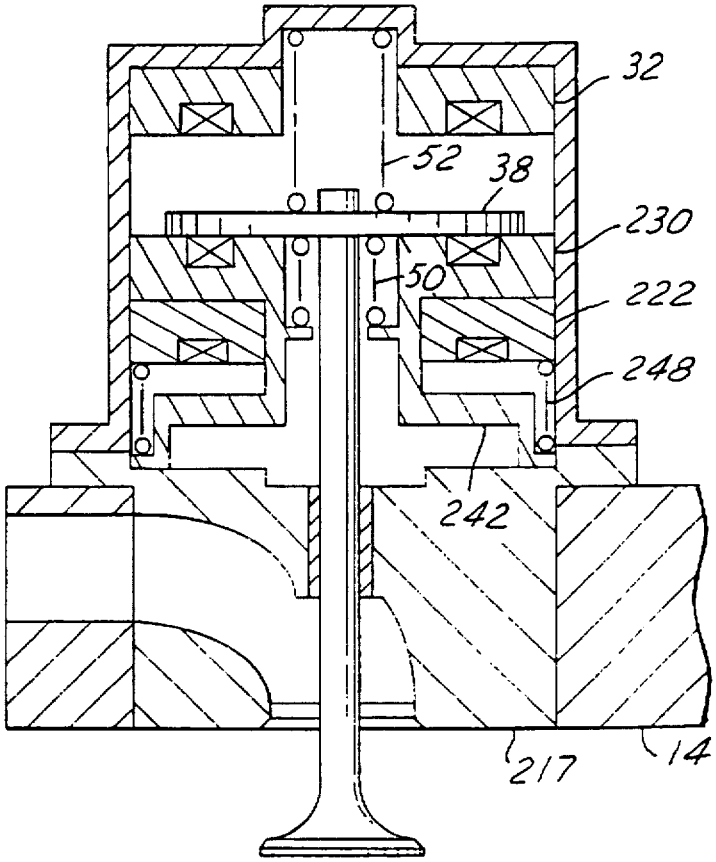
FIG. 6 is a schematic view similar to FIG. 1, but illustrating a fourth embodiment of the present invention.

FIG. 6 illustrates a fourth embodiment of the present invention. In this embodiment, like elements with the first embodiment will be similarly designated while changed elements will also be similarly designated but with a 200-series designation. The second electromagnet 230 now extends around the first electromagnet 222 toward the insert 217, forming a stop member 242, which replaces the stop ring. Also, the first spring 248 is mounted between the stop member 242 and the first electromagnet 222, now pushing downwards, rather than upwards, on the second electromagnet 230. Although, in this embodiment, the first spring 248 is optional.

In this embodiment, the first electromagnet 222 is energized during mid-open valve operation rather than during full-open operation. This is beneficial if less time is spent in the mid-open mode, than the full open mode. Depending upon whether the full open or mid-open operating mode is the most prevalent operating mode, the energy consumption for the first embodiment varies. In embodiment 1, the mid-open operating condition uses less energy than the full open since the first electromagnet 222 may be always on during full open operation, while in this embodiment the situation is reversed. Energy consumption is minimized in either embodiment since the electromagnet only needs to supply a low holding force, rather than a higher energy transient force used to pull the second electromagnet towards it.

While certain embodiments of the present invention have been described in detail, those familiar with the art to which this invention relates will recognize various alternative designs and embodiments for practicing the invention as defined by the following claims.

We claim:

1. An engine valve assembly for an internal combustion engine having a cylinder head, the engine valve assembly comprising:

an engine valve having a head portion and a stem portion, adapted to be slidably mounted within the cylinder head;

an actuator housing adapted to be mounted to the engine and surrounding a portion of the valve stem;

a first electromagnet, fixedly mounted relative to the actuator housing and encircling a portion of the valve stem;

a second electromagnet, slidably mounted relative to the actuator housing and encircling a portion of the valve stem farther from the head of the engine valve than the first electromagnet;

a third electromagnet, fixedly mounted relative to the actuator housing and encircling a portion of the valve stem farther from the head of the engine valve than the second electromagnet and spaced from the second electromagnet to form a gap;

a disk fixedly mounted to the engine valve stem and located between the second and third electromagnet;

first biasing means for biasing a portion of the second electromagnet away from the first electromagnet;

second biasing means for biasing the disk away from the second electromagnet;

third biasing means for biasing the disk toward the second electromagnet; and stop means for limiting the sliding of the portion of the second electromagnet away from the first electromagnet, allowing for a variable gap between the second electromagnet and third electromagnet, whereby variable engine valve lift may be achieved.

2. The engine valve assembly of claim 1 wherein the second biasing means is a spring mounted between the disk and the second electromagnet, and the third biasing means is a spring mounted between the disk and the actuator housing.

3. The engine valve assembly of claim 2 wherein the first biasing means is a spring adapted to be mounted between the cylinder head and the second electromagnet.

4. The engine valve assembly of claim 3 wherein the stop means is a stop ring fixedly mounted to the actuator housing, located between the second electromagnet and the third electromagnet and shaped to limit the sliding travel of the second electromagnet.

5. The engine valve assembly of claim 4 wherein the first electromagnet includes a permanent magnet mounted therein adjacent to the second electromagnet.

6. The engine valve assembly of claim 4 further including a pin protruding through the housing between the first electromagnet and the stop ring, and including a solenoid valve mounted to the pin, whereby the solenoid valve can selectively retract the pin.

7. The engine valve assembly of claim 2 wherein the second electromagnet includes a main portion and an extension portion, with the extension portion extending around the first electromagnet such that it encircles a portion of the valve stem closer to the head of the engine valve than the first electromagnet.

8. The engine valve assembly of claim 7 wherein the first biasing means is a spring mounted between the extension portion of the second electromagnet and the first electromagnet.

9. The engine valve assembly of claim 8 wherein the stop means is the extension portion of the second electromagnet, shaped to limit the sliding travel of the main portion of the second electromagnet away from the first electromagnet.

10. The engine valve assembly of claim 3 wherein the stop means is a stop ring fixedly mounted to the actuator housing, located between the second electromagnet and the third electromagnet and shaped to limit the sliding travel of the second electromagnet.

11. The engine valve assembly of claim 1 wherein the first electromagnet includes a permanent magnet mounted therein adjacent to the second electromagnet.

12. The engine valve assembly of claim 1 further including a pin protruding through the housing between the first electromagnet and the third electromagnet, and including a solenoid valve mounted to the pin, whereby the solenoid valve can selectively retract the pin.

13. An internal combustion engine for use in a vehicle comprising:

a cylinder head;

an engine valve having a head portion and a stem portion slidably mounted within the cylinder head;

an actuator housing mounted to the engine and surrounding a portion of the valve stem;

a first electromagnet, fixedly mounted relative to the actuator housing and encircling a portion of the valve stem;

a second electromagnet, slidably mounted relative to the actuator housing and encircling a portion of the valve stem farther from the head of the engine valve than the first electromagnet;

a third electromagnet, fixedly mounted relative to the actuator housing and encircling a portion of the valve stem farther from the head of the engine valve than the second electromagnet and spaced from the second electromagnet to form a gap;

a disk fixedly mounted to the engine valve stem and located between the second and third electromagnet;

first biasing means for biasing a portion of the second electromagnet away from the first electromagnet;

a spring mounted between the disk and the second electromagnet for biasing the disk away from the second electromagnet;

an opposed spring mounted between the disk and the actuator housing for biasing the disk toward the second electromagnet; and stop means for limiting the sliding of the portion of the second electromagnet away from the first electromagnet, allowing for a variable gap between the second electromagnet and third electromagnet, whereby variable engine valve lift may be achieved.

14. The engine of claim 13 wherein the engine valve is an intake valve.

15. The engine of claim 13 wherein the engine valve is an exhaust valve.

16. The engine of claim 13 wherein the cylinder head comprises a valve cavity and an insert member mounted within the cavity, with the engine valve slidably mounted within the insert.

17. The engine of claim 16 wherein the first electromagnet has a core member and this core member is integral with the insert.

18. The engine of claim 17 further including a pin protruding through the housing between the first electromagnet and the stop ring, and including a solenoid valve mounted to the pin, whereby the solenoid valve can selectively retract the pin.

19. The engine of claim 13 wherein the first electromagnet includes a permanent magnet mounted therein adjacent to the second electromagnet.

* * * * *